United States Patent [19]

Wright et al.

[11] Patent Number: 4,592,152

[45] Date of Patent: Jun. 3, 1986

[54] UNLASTED SHOE

[75] Inventors: Robert L. Wright, St. Louis County; Donald W. Zeuschel, St. Louis, both of Mo.

[73] Assignee: Brown Group, Inc., St. Louis, Mo.

[21] Appl. No.: 735,683

[22] Filed: May 20, 1985

[51] Int. Cl.[4] ..... A43B 3/12

[52] U.S. Cl. ..... 36/11.5; 36/7.5; 36/47; 36/48

[58] Field of Search ..... 36/11.5, 9 R, 9 A, 7.5, 36/47, 48

[56] References Cited

U.S. PATENT DOCUMENTS

| | | | |
|---|---|---|---|
| 1,753,702 | 4/1930 | Griffiths | 36/8.1 |
| 2,200,068 | 5/1940 | Levin | 36/11 |
| 2,239,206 | 4/1941 | Tietig | 36/11.5 |
| 2,582,910 | 1/1952 | Lyou | 36/2.5 |
| 3,057,085 | 10/1962 | Rigsby | 36/11.5 |
| 3,057,086 | 10/1962 | Rigsby | 36/11.5 |
| 4,107,857 | 8/1978 | Devlin | 36/11.5 |
| 4,355,473 | 10/1982 | Ilitzky | 36/48 |

FOREIGN PATENT DOCUMENTS

| | | | |
|---|---|---|---|
| 808008 | 1/1937 | France | 36/11.5 |
| 582906 | 12/1946 | United Kingdom | 36/11.5 |

OTHER PUBLICATIONS

Le Custume Historique, Racinet parrs 1888, vol. 2: Plate 44 Book #GT513R2.

*Primary Examiner*—Werner H. Schroeder
*Assistant Examiner*—Mary A. Ellis
*Attorney, Agent, or Firm*—Gravely, Lieder & Woodruff

[57] ABSTRACT

An unlasted shoe construction of the sandal type in which an upper is formed from one-piece of flexible material with vamp tabs and instep tabs integral therewith so that the tabs will be fully clear of the connection of the upper with a bottom. The instep tabs are provided to afford places to attach an instep strap and a heel strap to complete the sandal construction.

2 Claims, 5 Drawing Figures

UNLASTED SHOE

BACKGROUND OF THE INVENTION

1. Field of the Invention

This invention relates to shoe construction and to a method particularly directed to forming a shoe starting with the upper in a flat pattern layout so that a minimum of components are required to make a finished shoe.

2. Description of the Prior Art

It is typical in the manufacture of shoes to construct uppers on a last before applying an insole as well as the outsole. The last must support the upper and it is normal to form the upper from a number of components for the assembly. Another known construction is seen in Lyon U.S. Pat. No. 2,582,910 of 1952 where the shoe is made up in either sheet metal or resilient material such that it will support the step position of the foot without the aid of a heel component. This construction is made in two halves which are joined along a median line. Instead of metal, a shoe of the sandal character may be formed of a vinyl plastic material as in Tietig U.S. Pat. No. 2,239,206 of 1941.

An example of a one-piece shoe is seen in Griffiths U.S. Pat. No. 1,753,702 where the heel, counter and sole are molded of a rubber-compound in which the counter is molded in a first form and afterwards is notched so it can be given a curved shape by closing the notches and retaining the margin of the notches closed by a binding strip.

A further prior art example of a one-piece shoe is seen in Levin et al U.S. Pat. No. 2,200,068 of 1940. The shoe is formed on a last by stretching or wrapping the leather about the last so it conforms to the counter of the last. Thus the leather forms the sole, the toe box, the arch support, the heel seat, the counter and a considerable portion of the upper body. A further upper portion is then attached to complete a finished shoe. The leather is permanently set and will not lose its shape. A heel is then added.

BRIEF DESCRIPTION OF THE INVENTION

The present invention is directed to a novel and economical shoe construction and method of making a shoe upper of one piece of flexible material to which a bottom is attached to complete a finished shoe. The shoe begins as a flat pattern with the necessary marginal tab extension to receive the vamp, back strap and instep cross components. The flat pattern for the upper is brought into its desired form without the aid of a last due to the way the flat pattern is treated, and the way the components are attached.

A principal object of the invention is to provide a shoe upper in the form of essentially a one-piece flexible member without the need for lasting, and thereafter to add a bottom of generally conventional character.

Another object of the present invention is to provide an upper assembly which is the entire inner sole of a shoe without the need for lasting such that there is no need to attach components by the use of cement.

It is a further object of the present invention to form an inner sole of a single piece of flexible material with a series of vamp tabs that are angularly directed so as to suppress gaping when the shoe is worn.

Other objects will appear and be set forth in the following disclosure.

BRIEF DESCRIPTION OF THE DRAWINGS

The present shoe construction is seen in the accompanying drawings, wherein.

DETAILED DESCRIPTION OF THE INVENTION

A conventional procedure for making a shoe is centered around the use of a last such that the marginal or peripheral edges and tabs are required to be pulled or folded over on the last bottom and tacked or cemented in place over a liner ply. A disclosure of this procedure is seen in the U.S. Pat. No. 3,036,390, and it is well shown that the cemented tabs produce raised areas in the shoe that detract from the comfort of the foot as wear takes place and the tabs emboss ridges on the sock lining. It is a principal object of this invention to avoid the need for sock liners, eliminate cementing and thereby result in greater comfort over the period of usefulness with light weight shoes. Thus, it is possible to reduce shoe construction to its bare necessities and gain comfort with less weight and number of components.

Figure 1:
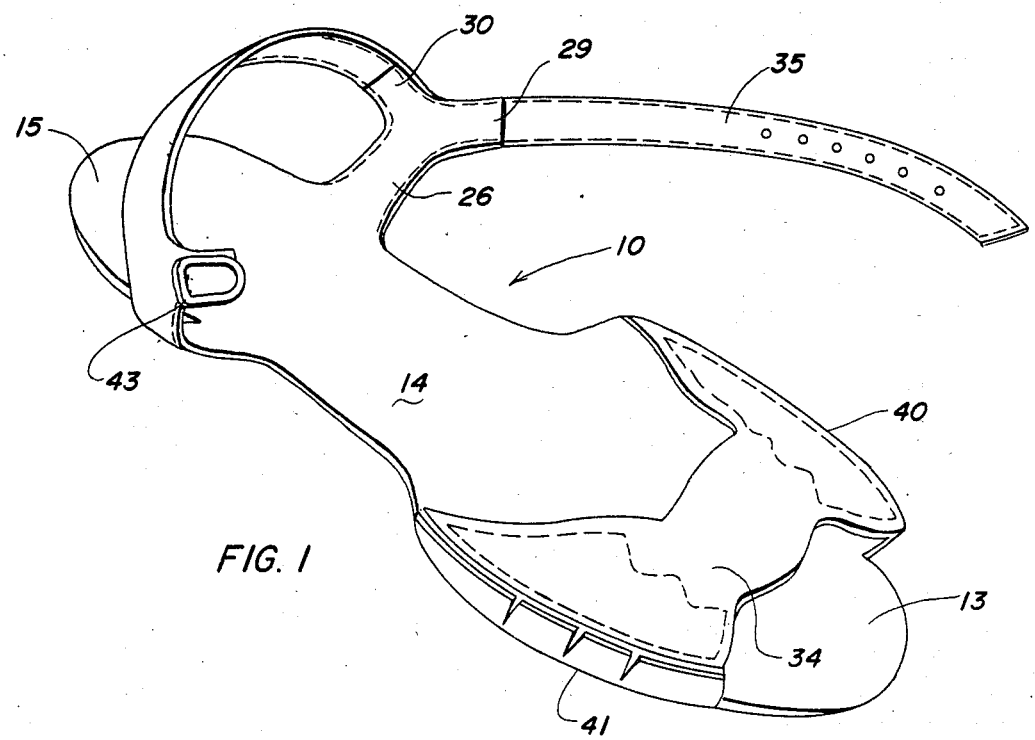
FIG. 1 is a perspective view of a sandal having the structural characteristics of this invention.
Figure 2:
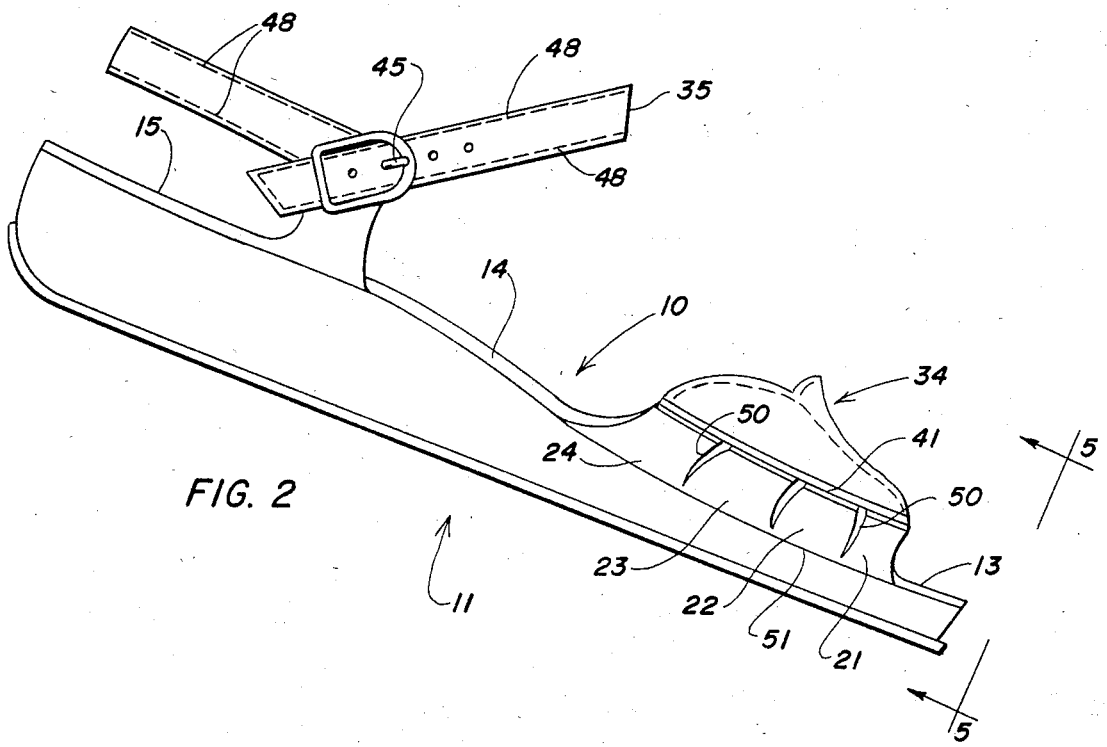
FIG. 2 is a side view of the sandal seen in FIG. 1 to show additional features of the construction and the addition of a bottom.

With the foregoing understanding of the general construction of a shoe, using a last for its formation, in mind, attention is directed to FIGS. 1 and 2 of the accompanying drawings for a general understanding of the construction of the present shoe which is a light weight sandal. The body of the shoe comprises an upper part 10 made of a single ply or sheet stock, and a bottom 11 that are attached together by cementing after the upper part 10 has been constructed.

Figure 3:
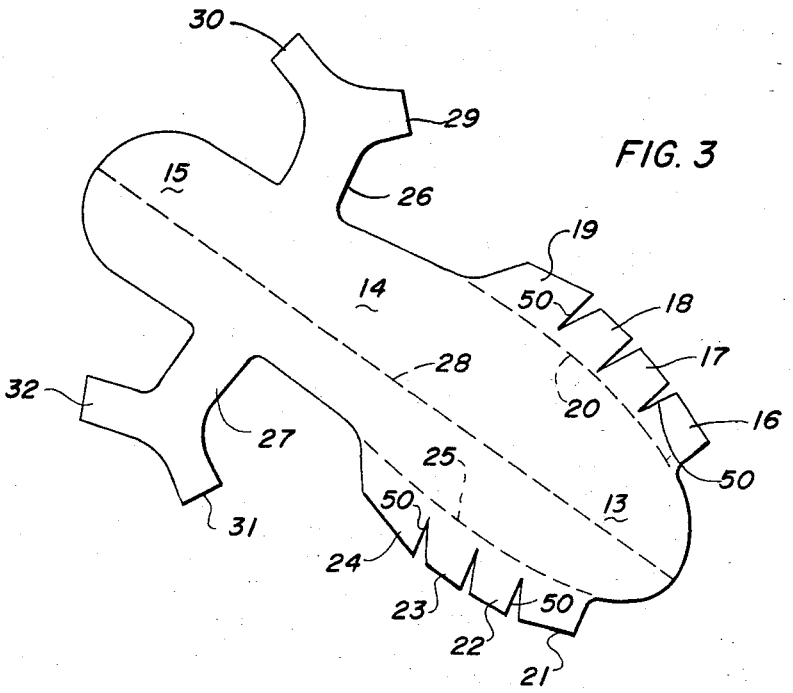
FIG. 3 is a view of the upper in its flat pattern form to depict the formation of the several tabs to which components may be secured.
Figure 4:
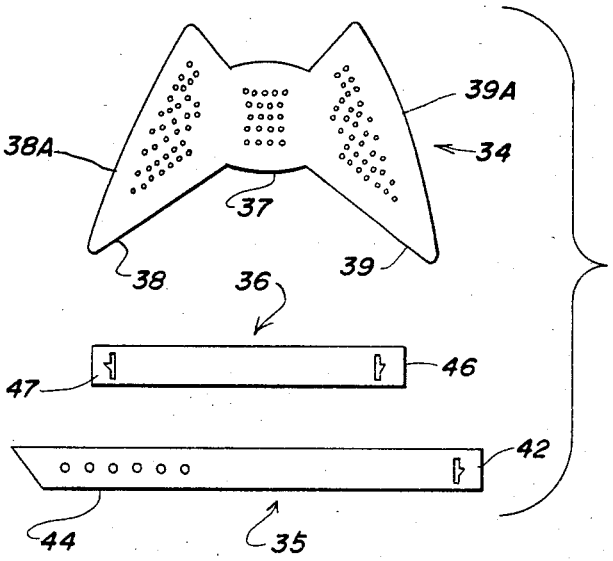
FIG. 4 is a view of a group of components seen in flat pattern layouts.

The upper part 10 is made up of a minimum number of components that are seen in FIGS. 3 and collectively in FIG. 4. FIG. 3 is a view in flat plan layout of the upper part 10 which is shaped with a toe area 13, an instep area 14, and a heel area 15, each of which should be familiar to those skilled in this art. The toe area 13 is characterized as having a series of vamp tabs 16, 17, 18, and 19 on one side margin denoted by the dotted outline 20, and a second series of vamp tabs 21, 22, 23, and 24 on the opposite side margin denoted by the dotted outline 25. In forming the vamp tabs, it becomes important to the proper fit of the upper 10 on a foot that the end tabs 16 and 19 on one side and the similar tabs 21 and 24 are sufficiently plyable and have an angularly formed margin that is capable of allowing these end tabs to be brought into positions that reduces as much as possible the formation of gaps at tabs 16, 19, 21, and 24 when the upper 10 is flexed as in walking.

Moreover, the flat pattern layout of the upper part 10 is provided between the instep area and the heel area with side projecting quarter tabs 26 and 27 which are approximately at right angles to the longitudinal axis of the upper indicated by the dotted line 28. The quarter tab 26 terminates in terminal ends 29 and 30 which angle forwardly and rearwardly, respectively. Similarly, quarter tab 27 ends up in terminal ends 31 and 32, which angle forwardly and rearwardly, respectively. The upper part 10 may be made of leather stock with the flesh side up and the skin side down so a very soft and smooth surface is presented to the foot.

Figure 5:
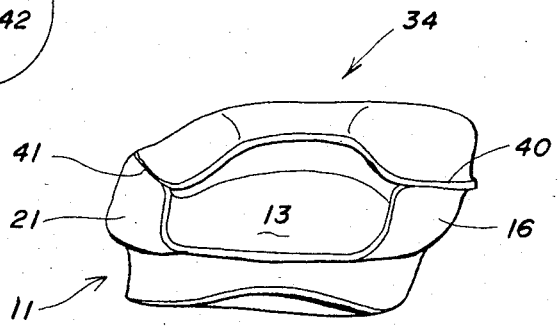
FIG. 5 is an end view taken along line 5—5 in FIG. 2 to show additional characteristics of the sandal.

In FIG. 4 there can be seen in a collective group a vamp component 34, instep strap component 35, and a back or heel strap 36. The vamp 34 in its flat pattern form is provided in a butterfly shape with a median body 37 and flared wings 38 and 39. The margins 38A and 39A are angled differently, compared to the more oval shape of the vamp tabs 16–19 and 21–24. As seen in FIG. 4, the ends of the vamp tabs follow the oval shape which is generally characteristic of the sides of the toe area, so that when they are folded up to form the sides of the toe area the normal shape of the foot is preserved. However, the vamp margins diverge from the oval shape. The reason for this difference lies in the desire to shape the vamp 34 and the vamp tabs at each side of the toe area such that the toe area will have the vamp in a standing or raised position, as illustrated in FIG. 5. The margins 38A and 39A are lap-joined to the respective vamp tabs 16–19 and 21–24 along outseams 40 and 41. In the outseaming operation, the forward vamp tabs 16 and 21 are positioned such that in walking there will be little or no gapping alongside the toes. Similarly, the vamp tabs 19 and 24 are positioned while being joined to the vamp wings 38A and 38A such that little or no gapping will occur at each side of the instep area 14.

Following the attachment of the vamp 34, a bottom 11 is attached by cementing. To attach the bottom, it is necessary to support the upper 10 by a last that will cup the toe area, bend the vamp tabs along the fold lines 20 and 25 (FIG. 3) and cause the vamp to stand up to receive a foot. Prior to this step, there is no need of a last as the vamp does not have margins which require cementing to an insole.

The upper is completed by cementing an end 42 of the instep strap 35 to the terminal end 29 of the quarter tab 26, mounting a buckle 43 on the terminal end 31 of the opposite quarter tab 27 to receive the instrap end 44 which has holes to be engaged by the buckle tongue 45 (FIG. 2) The back strap 36 is attached by cementing the end 46 to the terminal end 30 of the quarter tab 26, and cementing the other end 47 to the terminal end 32 of the quarter tab 27. The attachment of the straps 35 and 36 to the respective terminal ends 29, 30 and 32 is best accomplished by skiving the surfaces to be cemented in lapped abutment so that a smooth and almost invisable connection is provided.

There has been shown in FIG. 2 the addition of marginal lines of stitching 48 on the instep and back straps 35 and 36 to resist the tendency of the material to stretch or elongate after a period of use. The same stitching treatment can be applied to the vamp 34 to assist in retaining its shape and appearance in use. This sort of stitching treatment may be added at any convenient stage in the assembly of the components.

It is to be noted herein that all components and parts are fitted above the bottom of the upper 10, thereby avoiding the formation under the surface of the upper 10 of thickened areas or lumps which are not entirely masked by sock liners and inserts or pads. Furthermore, it has been noted above that the angular shaping of the vamp tabs 16–19 and 21–24, and especially the respective end tabs of those groups, is selected to reduce or eliminate gapping. These angular relationships are variable in relation to the heel lift of the bottom 11. While no angular values can be assigned, it is critical to the control of gapping that the end vamp tabs 16, 19 on one side and the vamp tabs 21, 24 on the opposite side should be flexible and have the slits 50 so directed and approaching the meeting line 51 (FIG. 2) with the bottom 11 that these tabs can be positioned on the margins of the vamp 34 for the express purpose of achieving a substantially gap free fit. This fit consideration is taken into account because the stitching of the vamp 34 to the vamp tabs cannot be done in the flat as these parts form a closed composite, and is completed before the bottom 11 is cemented to the upper 10.

While the foregoing drawings and the description relating thereto have shown an add-on vamp 34 adapted to be stitched to vamp tabs on the one-piece upper 10, we do not wish to be limited to that exact construction as the vamp tabs can be shaped and given added length to be formed together over the toe area 13 with skived and cemented connections to construct a vamp which in its original formation, is integral with the upper ply. Other variations or their equivalents are to be included within the scope of this disclosure and insofar as permitted by prior art not herein identified.

What is claimed is:

1. A shoe upper construction comprising:

(a) an elongated blank having heel, instep and toe areas, with said toe area having integrally formed vamp tabs along each side of the blank separated at a plurality of spaced places, said vamp tabs having lengths sufficient to enclose the side of a foot and individual outer ends that collectively conform to the marginal shape of the sides of said toe area and said tabs adjacent said instep area having margins angularly directed relative to the longitudinal axis of said blank;

(b) quarter tab means projecting from each side of said blank between said heel and instep areas, each quarter tab having angularly directed temianl ends, one branching forwardly and angularly outwardly of the instep area and another branching rearwardly and angularly outwardly of said heel area;

(c) vamp means having a body portion with opposite side margins for attachment to said individual vamp tabs at the sides of said toe area, the contour of said vamp side margins being shaped such that the dimension across the width adjacent the toe area is less than the dimension across the width adjacent the instep area whereby upon being secured to said vamp tabs in cooperating positions said vamp means is caused to be shaped transversely of said toe area into an arch substantially conforming to the foot of the wearer, and said tabs adjacent said instep area having said angularly directed margins directed to approach said vamp means for effecting a gap free fit;

(d) back strap means having its ends connected to said terminal ends of said quarter tabs that are branching alongside said heel area;

(e) instep strap means having one end connected to a terminal end of one of said quarter tabs that branches alongside the instep area; and (f) means carried by the terminal end of the other quarter tab means that branches alongside the instep area for engaging said instep strap by its opposite end.

2. In a sandal construction the improvement comprising:

(a) an upper of a one-piece flexible material having in flat layout, a toe area, an instep area and a heel area, said toe area having on opposite sides a series of projecting vamp tabs spaced apart and extending outwardly and individually foldable along fold lines to form the sides of the toe area, end ones of said series of vamp tabs adjacent said instep area having angularly divergent margins relative to said instep area being independently foldable for minimizing the formation of gaps at the opposite sides of the toe area;

(b) a quarter tab extending outwardly from said upper between said instep and heel area at each side thereof and each having a pair of oppositely angularly extending terminal ends;

(c) an instep strap connected to an extending terminal end on one quarter strap of said pair of oppositely angularly extending terminal ends and a strap receiving retainer connected to an extending terminal end on one of said pair of terminal ends on an opposite side quarter tab;

(d) a heel strap having ends connected to another one of said pair of oppositely extending terminal ends on each of said quarter tabs to position the foot in the upper; and (e) separate vamp means on said upper forming a composite closure over said toe area with said vamp tabs, said vamp means in flat pattern having median body and oppositely extending wings with margins that have contours different from said toe area sides such that on connection of said wing margins with said series of spaced vamp tabs, said median body and wings are held above said toe area in foot receiving position, and said end ones of said tabs are brought into positions for reducing gaps at the sides of the foot.

* * * * *